US011363840B2

(12) United States Patent
Courbat et al.

(10) Patent No.: US 11,363,840 B2
(45) Date of Patent: Jun. 21, 2022

(54) AEROSOL-GENERATING DEVICE WITH REMOVABLE SUSCEPTOR

(71) Applicant: Philip Morris Products S.A., Neuchatel (CH)

(72) Inventors: Jerome Christian Courbat, Cortaillod (CH); Oleg Fursa, Gempenach (CH); Oleg Mironov, Cudrefin (CH); Tony Reevell, London (GB); Andreas Michael Rossoll, Le Mont-sur-Lausanne (CH); Enrico Stura, Palezieux-Village (CH)

(73) Assignee: Philip Morris Products S.A., Neuchatel (CH)

( * ) Notice: Subject to any disclaimer, the term of this patent is extended or adjusted under 35 U.S.C. 154(b) by 237 days.

(21) Appl. No.: 16/623,694

(22) PCT Filed: Aug. 9, 2018

(86) PCT No.: PCT/EP2018/071704

§ 371 (c)(1),
(2) Date: Dec. 17, 2019

(87) PCT Pub. No.: WO2019/030360

PCT Pub. Date: Feb. 14, 2019

(65) Prior Publication Data

US 2020/0163385 A1 May 28, 2020

(30) Foreign Application Priority Data

Aug. 9, 2017 (EP) ..... 17185592

(51) Int. Cl.
*A24F 40/465* (2020.01)
*A24F 40/48* (2020.01)
(Continued)

(52) U.S. Cl.
CPC ..... *A24F 40/465* (2020.01); *A24F 40/48* (2020.01); *A24F 40/20* (2020.01); *A24F 40/50* (2020.01)

(58) Field of Classification Search
CPC ..... A24F 47/00
(Continued)

(56) References Cited

U.S. PATENT DOCUMENTS 5,665,262 A 9/1997 Hajaligol et al.
2012/2343151 9/2012 Li et al.
(Continued)

FOREIGN PATENT DOCUMENTS

CN 104095291 A 10/2014
CN 205648910 U 10/2016
(Continued)

OTHER PUBLICATIONS

Extended European Search Report dated Nov. 22, 2017, in Patent Application No. 17185592.7, 9 pages.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including a housing defining a chamber configured to receive at least a portion of an aerosol-generating article; an inductor coil disposed around at least a portion of the chamber; an elongate susceptor element configured for removable attachment to the housing within the chamber and projecting into the chamber when the element is removably attached to the housing; an aperture positioned on a side of the housing, the aperture and the element being configured for insertion of the element into the chamber through the aperture and configured for removal of the element from the chamber
(Continued)

through the aperture; and a power supply and a controller connected to the coil and to provide an alternating electric current to the coil such that the coil generates an alternating magnetic field to heat the element and thereby heat at least a portion of the article received within the chamber.

14 Claims, 5 Drawing Sheets

(51) Int. Cl.
*A24F 40/50* (2020.01)
*A24F 40/20* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2017/0055580 | A1 | 3/2017 | Blandino et al. | |
| 2017/0079326 | A1 | 3/2017 | Mironov | |
| 2017/0143042 | A1 | 5/2017 | Batista et al. | |
| 2017/0172214 | A1 | 6/2017 | Li et al. | |
| 2018/0310622 | A1 | 11/2018 | Mironov et al. | |
| 2020/0237008 | A1* | 7/2020 | Thorens | A24F 40/40 |
| 2020/0390156 | A1* | 12/2020 | An | A24F 40/51 |

FOREIGN PATENT DOCUMENTS

| | | | |
|---|---|---|---|
| EP | 2 444 112 | A1 | 4/2012 |
| RU | 2014131464 | | 7/2014 |
| WO | WO 95/27411 | A1 | 10/1995 |
| WO | WO 2014/048745 | A1 | 4/2014 |
| WO | WO 2015/131058 | A1 | 9/2015 |
| WO | WO 2015/175568 | A1 | 11/2015 |
| WO | WO 2015/176898 | A1 | 11/2015 |
| WO | WO 2015/177043 | A1 | 11/2015 |
| WO | WO 2015/177044 | A1 | 11/2015 |
| WO | WO 2015/177045 | A1 | 11/2015 |
| WO | WO 2015/177046 | A1 | 11/2015 |
| WO | WO 2015/177247 | A1 | 11/2015 |
| WO | WO 2015/177252 | A1 | 11/2015 |
| WO | WO 2015/177253 | A1 | 11/2015 |
| WO | WO 2015/177254 | A1 | 11/2015 |
| WO | WO 2015/177257 | A1 | 11/2015 |
| WO | WO 2015/177263 | A1 | 11/2015 |
| WO | WO 2015/177264 | A1 | 11/2015 |
| WO | WO 2015/177265 | A1 | 11/2015 |
| WO | WO 2015/198015 | A1 | 12/2015 |
| WO | WO 2016/005601 | A1 | 1/2016 |
| WO | WO 2016/075436 | A1 | 5/2016 |
| WO | WO 2016/090037 | A1 | 6/2016 |
| WO | WO 2016/156500 | A1 | 10/2016 |
| WO | WO 2016/184928 | A1 | 11/2016 |
| WO | WO 2016/184929 | A1 | 11/2016 |
| WO | WO 2016/184930 | A1 | 11/2016 |
| WO | WO 2017/001818 | A1 | 1/2017 |
| WO | WO 2017/001819 | A1 | 1/2017 |
| WO | WO 2017/001820 | A1 | 1/2017 |
| WO | WO 2017/005705 | A1 | 1/2017 |
| WO | WO 2017/029268 | A1 | 2/2017 |
| WO | WO 2017/029269 | A1 | 2/2017 |
| WO | WO 2017/029270 | A1 | 2/2017 |
| WO | WO 2017/036950 | A2 | 3/2017 |
| WO | WO 2017/036951 | A1 | 3/2017 |
| WO | WO 2017/036954 | A1 | 3/2017 |
| WO | WO 2017/036955 | A2 | 3/2017 |
| WO | WO 2017/036957 | A1 | 3/2017 |
| WO | WO 2017/036958 | A2 | 3/2017 |
| WO | WO 2017/036959 | A1 | 3/2017 |
| WO | WO 2017/064487 | A1 | 4/2017 |
| WO | WO 2017/068092 | A1 | 4/2017 |
| WO | WO 2017/068095 | A1 | 4/2017 |
| WO | WO 2017/068098 | A1 | 4/2017 |
| WO | WO 2017/068099 | A1 | 4/2017 |
| WO | WO 2017/068100 | A1 | 4/2017 |
| WO | WO 2017/072144 | A1 | 5/2017 |
| WO | WO 2017/072145 | A1 | 5/2017 |
| WO | WO 2017/072148 | A1 | 5/2017 |
| WO | WO 2017/072149 | A1 | 5/2017 |
| WO | WO 2017/077503 | A1 | 5/2017 |
| WO | WO 2017/085242 | A1 | 5/2017 |
| WO | WO 2018/041450 | A1 | 3/2018 |
| WO | WO 2018/146071 | A1 | 8/2018 |
| WO | WO 2018/220558 | A1 | 12/2018 |

OTHER PUBLICATIONS

European Office Action dated March 2, 2021 in European Patent Application No. 18 755 430.8, citing document AO therein, 6 pages
Decision to Grant dated Nov. 11, 2021 in Russian Application No. 2020104966/03 (with Computer Generated English Translation)(citing reference AA and AO therein).
Search Report dated Nov. 11, 2021 in Russian Application No. 2020104966/03 (with Computer Generated English Translation)(citing reference AA and AO therein).
International Search Report dated Nov. 16, 2018 in PCT/EP2018/071704 filed on Aug. 9, 2018, citing documents AA-AE and AO-AV, therein 5 pages.
Written Opinion dated Nov. 16, 2018 in PCT/EP2018/071704 filed on Aug. 9, 2018.

* cited by examiner

AEROSOL-GENERATING DEVICE WITH REMOVABLE SUSCEPTOR

CROSS-REFERENCE TO RELATED APPLICATIONS

This application is a U.S. national stage application of PCT/EP2018/071704, filed on Aug. 9, 2018, which is based upon and claims the benefit of priority from European patent application no. 17185592.7, filed Aug. 9, 2017, the entire contents of each of which are incorporated herein by reference.

TECHNICAL FIELD

The present invention relates to an aerosol-generating device comprising an inductor coil and a susceptor configured for removable attachment to the aerosol-generating device. The present invention also relates to an aerosol-generating system comprising the aerosol-generating device and an aerosol-generating article for use with the aerosol-generating device.

DESCRIPTION OF THE RELATED ART

A number of electrically-operated aerosol-generating systems in which an aerosol-generating device having an electric heater is used to heat an aerosol-forming substrate, such as a tobacco plug, have been proposed in the art. One aim of such aerosol-generating systems is to reduce known harmful smoke constituents of the type produced by the combustion and pyrolytic degradation of tobacco in conventional cigarettes. Typically, the aerosol-generating substrate is provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element such as a heating blade is inserted into or around the aerosol-forming substrate when the article is received in the aerosol-generating device. In other aerosol-generating systems, an inductive heater is used rather than a resistive heating element. The inductive heater typically comprises an inductor forming part of the aerosol-generating device and an electrically conductive susceptor element fixed within the aerosol-generating device and arranged such that it is in thermal proximity to the aerosol-forming substrate. During use, the inductor generates an alternating magnetic field to generate eddy currents and hysteresis losses in the susceptor element, causing the susceptor element to heat up, thereby heating the aerosol-forming substrate.

In known systems having an inductor and a susceptor element, the susceptor element may become contaminated over time with deposits from aerosol-forming substrates heated by the susceptor element. The build-up of deposits may result in an undesirable flavour or taste sensation for a user each time the susceptor element is heated. Cleaning the susceptor element may be difficult, since the susceptor element is typically housed within a chamber or cavity within which aerosol-generating articles to be heated are received.

It would be desirable to provide an aerosol-generating device that mitigates or overcomes these problems with known systems.

SUMMARY

According to a first aspect of the present invention there is provided an aerosol-generating device comprising a housing defining a chamber for receiving at least a portion of an aerosol-generating article and an inductor coil disposed around at least a portion of the chamber. The aerosol-generating device also comprises an elongate susceptor element configured for removable attachment to the housing within the chamber, wherein the elongate susceptor element projects into the chamber when the elongate susceptor element is removably attached to the housing. The aerosol-generating device also comprises a power supply and a controller connected to the inductor coil. The power supply and the controller are configured to provide an alternating electric current to the inductor coil such that, in use, the inductor coil generates an alternating magnetic field to heat the elongate susceptor element and thereby heat at least a portion of an aerosol-generating article received within the chamber.

According to a second aspect of the present invention there is provided an aerosol-generating system. The aerosol-generating system comprises an aerosol-generating device according to the first aspect of the present invention, in accordance with any of the embodiments described herein. The aerosol-generating system also comprises an aerosol-generating article having an aerosol-forming substrate and configured for use with the aerosol-generating device.

BRIEF DESCRIPTION OF THE DRAWINGS

The invention is further described, by way of example only, with reference to the accompanying drawings in which.

DETAILED DESCRIPTION

Figure 1:
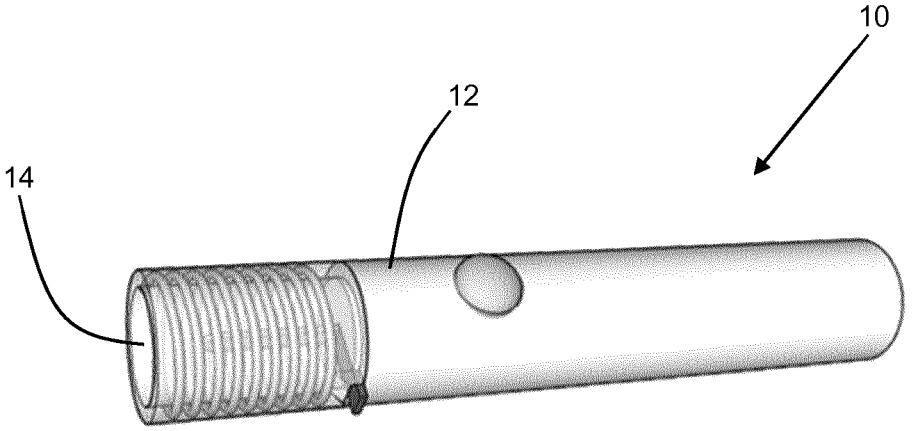
FIG. 1 shows a perspective view of an aerosol-generating device according to a first embodiment of the present invention.

As used herein, the term "longitudinal" is used to describe the direction along the main axis of the aerosol-generating device, or of an aerosol-generating article, and the term 'transverse' is used to describe the direction perpendicular to the longitudinal direction. When referring to the chamber, the term 'longitudinal' refers to the direction in which an aerosol-generating article is inserted into the chamber and the term 'transverse' refers to a direction perpendicular to the direction in which an aerosol-generating article is inserted into the chamber.

As used herein, the term "width" refers to the major dimension in a transverse direction of a component of the aerosol-generating device, or of an aerosol-generating article, at a particular location along its length. The term "thickness" refers to the dimension of a component of the aerosol-generating device, or of an aerosol-generating article, in a transverse direction perpendicular to the width.

As used herein, the term "aerosol-forming substrate" relates to a substrate capable of releasing volatile compounds that can form an aerosol. Such volatile compounds may be released by heating the aerosol-forming substrate. An aerosol-forming substrate is part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In an aerosol-generating system, the aerosol-generating article and the aerosol-generating device cooperate to generate a respirable aerosol.

As used herein, the term "elongate" refers to a component having a length which is greater than both its width and thickness, for example twice as great.

As used herein, a "susceptor element" means an electrically conductive element that heats up when subjected to a changing magnetic field. This may be the result of eddy currents induced in the susceptor element, hysteresis losses, or both eddy currents and hysteresis losses. The susceptor element is located in thermal contact or close thermal proximity with the aerosol-forming substrate of an aerosol-generating article received in the chamber of the aerosol-generating device. In this manner, the aerosol-forming substrate is heated by the susceptor element during use such that an aerosol is formed.

Advantageously, aerosol-generating devices according to the present invention comprise a susceptor element that is removable from the aerosol-generating device. Advantageously, this facilitates cleaning of the susceptor element, replacement of the susceptor element, or both.

Using inductive heating has the advantage that the heating element, in this case the susceptor element, need not be electrically joined to any other components, eliminating the need for solder or other bonding elements for the heating element. Advantageously, this facilitates removal of the susceptor element from the aerosol-generating device and attachment of the susceptor element to the aerosol-generating device by a user.

Advantageously, providing an inductor coil and a susceptor element as parts of the device makes it possible to construct an aerosol-generating article that is simple, inexpensive and robust. Aerosol-generating articles are typically disposable and produced in much larger numbers that the aerosol-generating devices with which they operate. Accordingly, reducing the cost of the articles, even if it requires a more expensive device, can lead to significant cost savings for both manufacturers and consumers.

Advantageously, the use of inductive heating rather than a resistive heater may provide improved energy conversion because of power losses associated with a resistive heater, in particular losses due to contact resistance at connections between the resistive heater and the power supply.

Advantageously, using an inductor coil rather than a resistive coil may extend the lifetime of the aerosol-generating device since the inductor coil itself undergoes minimal heating during use of the aerosol-generating device. Advantageously, the part of the aerosol-generating device that is heated and may therefore exhibit a shorter lifetime is the susceptor element, which is removable from the aerosol-generating device and can be replaced easily.

The aerosol-generating device may comprise an aperture positioned on a side of the housing, wherein the aperture and the elongate susceptor element are configured for insertion of the elongate susceptor element into the chamber through the aperture and configured for removal of the elongate susceptor element from the chamber through the aperture. Advantageously, providing an aperture positioned on a side of the housing may facilitate insertion and removal of the elongate susceptor element at the desired location within the chamber. This configuration may be particularly advantageous in embodiments in which the elongate susceptor element is positioned at a closed end of the chamber and opposite from an open end of the chamber through which aerosol-generating articles are inserted.

The elongate susceptor element may comprise an elongate base portion and an elongate heating portion extending from a first end of the elongate base portion, wherein the elongate base portion is orthogonal to the elongate heating portion.

Advantageously, the orthogonal relationship between the elongate base portion and the elongate heating portion may facilitate insertion of the elongate susceptor element through the aperture and removal of the elongate susceptor element through the aperture. For example, to insert the elongate susceptor element, the elongate susceptor element may be rotated through an angle of approximately 90 degrees at the same time as the elongate heating portion is inserted through the aperture. Advantageously, this arrangement may minimise the required size of the aperture. For example, the maximum dimension of the aperture may be significantly smaller than the lengths of the elongate heating portion and the elongate base portion. Advantageously, this arrangement may also support the use of an elongate heating portion having a length that is longer than a width of the chamber.

The housing may define a channel extending at least partially across an upstream end of the chamber from the aperture, wherein the channel is configured to receive the elongate base portion of the elongate susceptor element. Advantageously, the channel may facilitate insertion of the elongate susceptor element into the chamber in the correct position and orientation. That is, the channel may function as a guide to guide the elongate susceptor element into the correct position and orientation within the chamber. Advantageously, the channel may engage with the elongate base portion to retain the elongate susceptor element in the correct position and orientation within the chamber.

The channel may be configured to retain the elongate base portion of the elongate susceptor element by an interference fit.

The housing may define at least one flange extending across at least a portion of the channel, wherein the at least one flange is configured to retain the elongate base portion of the elongate susceptor portion within the channel. For example, the at least one flange may overlap at least a portion of the elongate base portion to retain the elongate base portion within the channel.

The at least one flange may at least partially define a slot. The at least one flange may comprise a first flange overlying a first portion of the channel and a second flange overlying a second portion of the channel, wherein the first flange is spaced apart from the second flange to define the slot between the first flange and the second flange.

Preferably, the channel, the slot and the elongate susceptor element are configured so that the elongate heating portion of the elongate susceptor element extends through the slot when the elongate base portion is retained within the channel. Advantageously, the slot allows the elongate heating portion to extend into the chamber. Advantageously, the at least one flange facilitates retention of the elongate base portion within the channel.

Preferably, the slot comprises a first width and the channel comprises a second width, wherein the first width is narrower than the second width. Preferably, the elongate heating portion comprises a third width and the elongate base portion comprises a fourth width, wherein the third width is narrower than the fourth width.

Advantageously, the narrower width of the slot compared to the channel may prevent the elongate base portion passing through the slot.

Advantageously, the narrower width of the elongate heating portion compared to the elongate base portion facilitates the insertion of the elongate base portion into the slot and may prevent the elongate base portion passing through the slot.

Preferably, the first, second, third and fourth widths are sized to facilitate sliding of the elongate heating portion within the slot and sliding of the elongate base portion within the channel during insertion and removal of the elongate susceptor element.

Preferably, a portion of the elongate susceptor element is configured to protrude through the aperture when the elongate susceptor element is received within the chamber. Advantageously, this may facilitate grasping of the elongate susceptor element by a user to remove the elongate susceptor element from the aerosol-generating device. In embodiments in which the elongate susceptor element comprises an elongate base portion, preferably a second end of the elongate base portion is configured to protrude through the aperture when the elongate susceptor element is received within the chamber.

The elongate susceptor element may comprise a base portion configured for removable attachment to the housing and an elongate heating portion extending from the base portion.

Preferably, the housing comprises an opening at an end of the chamber for insertion of an aerosol-generating article into the chamber. Preferably, the base portion of the elongate susceptor element is sized and shaped for insertion of the elongate susceptor element into the chamber through the opening. Advantageously, this may eliminate the need for a separate aperture to facilitate insertion of the elongate susceptor element into the chamber.

Preferably, a cross-sectional shape of the base portion is substantially the same as a cross-sectional shape of the chamber. The base portion may have a substantially circular cross-sectional shape.

The elongate heating portion may be detachable from the base portion. Advantageously, this may facilitate re-use of the base portion with multiple elongate heating portions. This may be desirable, since the build-up of deposits may occur more quickly on the elongate heating portion than the base portion.

Preferably, the elongate heating portion extends from a centre of the base portion. Advantageously, this may eliminate the need for a user to insert the elongate susceptor element into the chamber in any particular rotational orientation. This may be particularly desirable in embodiments in which the base portion has a substantially circular cross-sectional shape.

Advantageously, positioning the elongate heating portion in the centre of the base portion may facilitate positioning of the elongate heating portion along a central axis of the chamber. Advantageously, this may facilitate even heating of an aerosol-forming substrate of an aerosol-generating article received within the chamber.

The base portion of the elongate susceptor element may be configured for removable attachment to the housing by a magnetic attachment. Advantageously, a magnetic attachment provides a simple and effective mechanism for removably attaching the elongate susceptor element to the aerosol-generating device.

The base portion may comprise a permanent magnet and the aerosol-generating device may comprise a ferromagnetic material at an upstream end of the chamber. The base portion may comprise a ferromagnetic material and the aerosol-generating device may comprise a permanent magnet at an upstream end of the chamber. Advantageously, providing only one of the base portion and the aerosol-generating device with a permanent magnet may simplify and reduce the cost of manufacture of the aerosol-generating device.

The base portion may comprise a permanent magnet and the aerosol-generating device may comprise a permanent magnet at an upstream end of the chamber. Advantageously, providing both the base portion and the aerosol-generating device with a permanent magnet may increase the strength of the magnetic attachment when compared to embodiments comprising only a single permanent magnet. Advantageously, the permanent magnet in the base portion and the permanent magnet in the aerosol-generating device may each be oriented to that the attraction between the two permanent magnets results in a desired orientation of the elongate susceptor element when the elongate susceptor element is inserted into the chamber.

The aerosol-generating device may further comprise a release mechanism configured to provide relative movement between the elongate susceptor element and the aerosol-generating device to break the magnetic attachment. The release mechanism may comprise at least one of a button and a lever.

The aerosol-generating device may comprise a button extending through a portion of the housing and moveable between a raised position and a depressed position. A tapered element extends from an internal end of the button and is positioned so that pushing the button from the raised position to the depressed position inserts the tapered portion between the base portion of the elongate susceptor element and the portion of the aerosol-generating device comprising either a permanent magnet or a ferromagnetic material. The increasing width of the tapered portion progressively increases the separation between the base portion and the portion of the aerosol-generating device comprising either a permanent magnet or a ferromagnetic material until the elongate susceptor element is released from the magnetic attachment. Preferably, the aerosol-generating device further comprises a biasing element to bias the button away from the depressed position and towards the raised position. Preferably, the biasing element comprises a spring.

The aerosol-generating device may comprise a lever extending through a portion of the housing and moveable between an engaged position and a disengaged position. The lever is configured so that moving the lever from the engaged position to the disengaged position moves one of the base portion of the elongate susceptor element and the portion of the aerosol-generating device comprising either a permanent magnet or a ferromagnetic material. The resulting movement increases the separation between the base portion and the portion of the aerosol-generating device comprising either a permanent magnet or a ferromagnetic material until the elongate susceptor element is released from the magnetic attachment. Preferably, the aerosol-generating device further comprises a biasing element to bias the lever away from the disengaged position and towards the engaged position. Preferably, the biasing element comprises a spring.

In embodiments in which the base portion of the elongate susceptor element is configured for removable attachment to the housing by a magnetic attachment, the aerosol-generating device may be combined with an extraction tool for removing the elongate susceptor element from the chamber. Preferably, the extraction tool is sized for insertion into the chamber and comprises a permanent magnet at an end of the extraction tool. The permanent magnet at the end of the extraction tool provides a stronger attractive force between the extraction tool and the base portion than the attractive force between the base portion and the aerosol-generating device. Preferably, the extraction tool comprises a cavity for receiving the elongate heating portion of the elongate susceptor element when the extraction tool is inserted into the chamber.

The elongate susceptor may be configured to detachably connect to the housing by at least one of an interference fit, a bayonet connector, and a screw connector.

In any of the embodiments described herein, preferably at least a portion of the elongate susceptor element extends in the longitudinal direction of the chamber when the elongate susceptor element is received within the chamber. That is, preferably at least a portion of the elongate susceptor element extends substantially parallel with the longitudinal axis of the chamber. As used, herein, the term "substantially parallel" means within plus or minus 10 degrees, preferably within plus or minus 5 degrees. Advantageously, this facilitates insertion of at least a portion of the elongate susceptor element into an aerosol-generating article when the aerosol-generating article is inserted into the chamber.

In embodiments in which the elongate susceptor element comprises an elongate heating portion, preferably the elongate heating portion extends in the longitudinal direction of the chamber.

The magnetic axis of the inductor coil may be at an angle to the longitudinal axis of the chamber. That is, the magnetic axis of the inductor coil may be non-parallel with the longitudinal axis of the chamber. In preferred embodiments, the magnetic axis of the inductor coil is substantially parallel with the longitudinal axis of the chamber. This may facilitate a more compact arrangement. Preferably, at least a portion of the elongate susceptor element is substantially parallel with the magnetic axis of the inductor coil. The may facilitate even heating of the elongate susceptor element by the inductor coil. In particularly preferred embodiments, the elongate susceptor element is substantially parallel with the magnetic axis of the inductor coil and with the longitudinal axis of the chamber.

Preferably, the elongate susceptor element comprises a free end projecting into the chamber when the elongate susceptor element is received within the chamber. Preferably, the free end is inserted into an aerosol-generating article when the aerosol-generating article is inserted into the chamber. Preferably, the free end is tapered. That is, the cross-sectional area of a portion of the elongate susceptor element decreases in a direction towards the free end. Advantageously, a tapered free end facilitates insertion of the elongate susceptor element into an aerosol-generating article. Advantageously, a tapered free end may reduce the amount of aerosol-forming substrate displaced by the elongate susceptor element during insertion of an aerosol-generating article into the chamber. This may reduce the amount of cleaning required.

Further optional and preferred features of the elongate susceptor element will now be described. In embodiments in which the elongate susceptor element comprises an elongate heating portion, the following optional and preferred features apply to the elongate heating portion.

The elongate susceptor element may be formed from any material that can be inductively heated to a temperature sufficient to aerosolise an aerosol-forming substrate. Suitable materials for the elongate susceptor element include graphite, molybdenum, silicon carbide, stainless steels, niobium, and aluminium. Preferred elongate susceptor elements comprise a metal or carbon. Preferably, the elongate susceptor element comprises or consists of a ferromagnetic material, for example, ferritic iron, a ferromagnetic alloy, such as ferromagnetic steel or stainless steel, ferromagnetic particles, and ferrite. A suitable elongate susceptor element may be, or comprise, aluminium. The elongate susceptor element preferably comprises more than about 5 percent, preferably more than about 20 percent, more preferably more than about 50 percent or more than 90 percent of ferromagnetic or paramagnetic materials. Preferred elongate susceptor elements may be heated to a temperature in excess of about 250 degrees Celsius.

The elongate susceptor element may comprise a non-metallic core with a metal layer disposed on the non-metallic core. For example, the elongate susceptor element may comprise one or more metallic tracks formed on an outer surface of a ceramic core or substrate.

The elongate susceptor element may have a protective external layer, for example a protective ceramic layer or protective glass layer. The protective external layer may encapsulate the elongate susceptor element. The elongate susceptor element may comprise a protective coating formed by a glass, a ceramic, or an inert metal, formed over a core of susceptor material.

The elongate susceptor element may have any suitable cross-section. For example, the elongate susceptor element may have a square, oval, rectangular, triangular, pentagonal, hexagonal, or similar cross-sectional shape. The elongate susceptor element may have a planar or flat cross-sectional area.

The elongate susceptor element may be solid, hollow, or porous. Preferably, the elongate susceptor element is solid. The elongate susceptor element is preferably in the form of a pin, rod, blade, or plate. The elongate susceptor element preferably has a length of between about 5 millimetres and about 15 millimetres, for example between about 6 millimetres and about 12 millimetres, or between about 8 millimetres and about 10 millimetres. The elongate susceptor element preferably has a width of between about 1 millimetre and about 8 millimetres, more preferably from about 3 millimetres to about 5 millimetres. The elongate susceptor element may have a thickness of from about 0.01 millimetres to about 2 millimetres. If the elongate susceptor element has a constant cross-section, for example a circular cross-section, it has a preferable width or diameter of between about 1 millimetre and about 5 millimetres.

In embodiments in which the elongate susceptor element comprises an elongate heating portion and a base portion, the elongate heating portion and the base portion may be formed from the same material. The elongate heating portion and the base portion may be integrally formed as a unitary part.

The elongate heating portion and the base portion may be formed from different materials. The elongate heating portion and the base portion may be separately formed and connected to each other. The elongate heating portion and the base portion may be connected to each other by at least one of an interference fit, a weld and an adhesive.

The base portion may be formed from a material that is not susceptible to inductive heating. Advantageously, this may reduce heating of the base portion during use of the aerosol-generating device. This may be particularly advantageous in embodiments in which a portion of the base portion protrudes through an aperture in the device housing when the elongate susceptor element is received within the chamber.

The base portion may be formed from a material that can be inductively heated. Advantageously, this may simplify the manufacture of the elongate susceptor element. In particular, the base portion and the elongate heating portion can be formed from the same material. Advantageously, forming the base portion from a material that can be inductively heating may provide additional heating of an aerosol-generating article during use.

Preferably, the aerosol-generating device is portable. The aerosol-generating device may have a size comparable to a conventional cigar or cigarette. The aerosol-generating device may have a total length between approximately 30 millimetres and approximately 150 millimetres. The aerosol-generating device may have an external diameter between approximately 5 millimetres and approximately 30 millimetres.

The aerosol-generating device housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

Alternatively, the mouthpiece may be provided as part of an aerosol-generating article.

As used herein, the term "mouthpiece" refers to a portion of an aerosol-generating device that is placed into a user's mouth in order to directly inhale an aerosol generated by the aerosol-generating device from an aerosol-generating article received in the chamber of the housing.

The aerosol-generating device may include a user interface to activate the device, for example a button to initiate heating of the device or display to indicate a state of the device or of the aerosol-forming substrate.

The aerosol-generating device comprises a power supply. The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be a DC power supply. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The power supply may be configured to operate at high frequency. As used herein, the term "high frequency oscillating current" means an oscillating current having a frequency of between about 500 kilohertz and about 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The aerosol-generating device comprises a controller connected to the inductor coil and the power supply. The controller is configured to control the supply of power to the inductor coil from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the inductor coil. Current may be supplied to the inductor coil continuously following activation of the aerosol-generating device or may be supplied intermittently, such as on a puff by puff basis. The controller may advantageously comprise DC/AC inverter, which may comprise a Class-D or Class-E power amplifier.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate comprises a gathered crimped sheet of homogenised tobacco material.

As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the chamber of the aerosol-generating device may be arranged such that the article is partially received within the chamber of the aerosol-generating device. The chamber of the aerosol-generating device and the aerosol-generating article may be arranged such that the article is entirely received within the chamber of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 millimetres. Alternatively, the aerosol-forming segment may have a length of approximately 12 millimetres.

The aerosol-generating segment preferably has an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug is approximately 7 millimetres in length in one embodiment, but may have a length of between approximately 5 millimetres to approximately 10 millimetres.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

Figure 2:
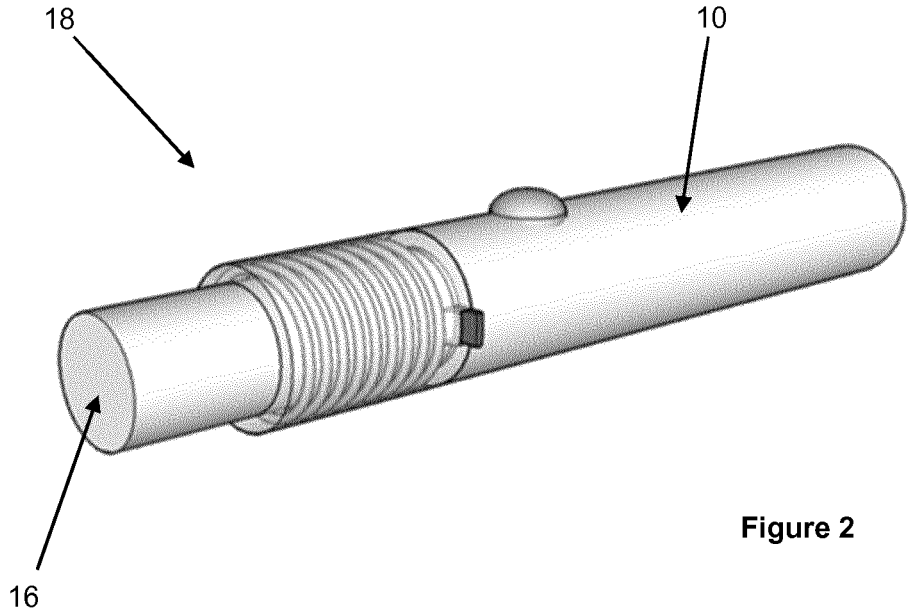
FIG. 2 shows a perspective view of an aerosol-generating system comprising the aerosol-generating device of FIG. 1.
Figure 3:
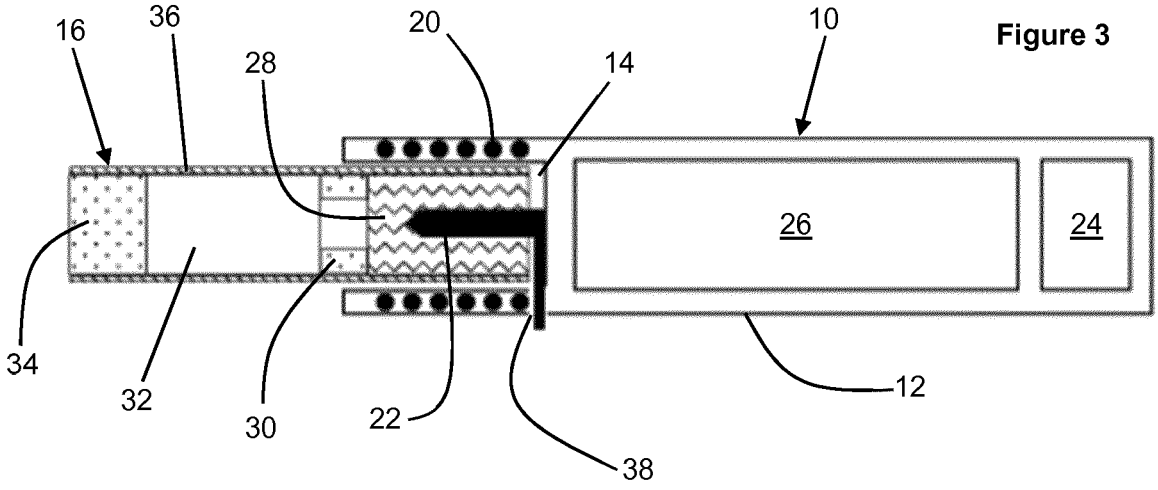
FIG. 3 shows a cross-sectional view of the aerosol-generating system of FIG. 2.

FIG. 1 shows an aerosol-generating device 10 comprising a housing 12 defining a chamber 14 for receiving an aerosol-generating article 16. FIGS. 2 and 3 show the aerosol-generating device 10 in combination with an aerosol-generating article 16 to form an aerosol-generating system 18.

In FIGS. 1 and 2 a portion of the housing 12 defining the chamber 14 is shown as semi-transparent to illustrate components of the aerosol-generating device 10 disposed within the chamber 14. However, it will be understood that the portion of the housing 12 defining the chamber 14 may comprise an opaque material.

The aerosol-generating device 10 further comprises an inductor coil 20 disposed around the chamber 14 and an elongate susceptor element 22 positioned within the inductor coil 20. The chamber 14 comprises an open end through which the aerosol-generating article 16 is received and a closed end opposite the open end. The elongate susceptor element 22 extends into the chamber 14 from the closed end.

The aerosol-generating device 10 also comprises a controller 24 and a power supply 26 connected to the inductor coil 20. The controller 24 is configured to provide an alternating electric current from the power supply 26 to the inductor coil 20 to generate an alternating magnetic field, which inductively heats the elongate susceptor element 22.

The aerosol-generating article 16 comprises an aerosol-forming substrate 28 in the form of a tobacco plug, a hollow acetate tube 30, a polymeric filter 32, a mouthpiece 34 and an outer wrapper 36. During use, a portion of the aerosol-generating article 16 is inserted into the chamber 14 so that the elongate susceptor element 22 is inserted into the aerosol-forming substrate 28. The controller 24 provides the alternating electric current to the inductor coil 20 to inductively heat the elongate susceptor element 22, which heats the aerosol-forming substrate 28 to generate an aerosol. A user draws on the mouthpiece 34 to draw air through the aerosol-generating article 16 and deliver the aerosol to the user.

The elongate susceptor element 22 is configured for removable attachment to the housing 12 of the aerosol-generating device 10. To enable insertion and removal of the elongate susceptor element 22 into and out of the chamber 14, the housing 12 defines an aperture 38 extending through a side of the housing 12 and communicating with the closed end of the chamber 14. The elongate susceptor element 22 comprises an elongate base portion 40 and an elongate heating portion 42 orthogonal to the elongate base portion 40 and extending from an end of the elongate base portion 40.

FIGS. 4 to 7 show the portion of the housing 12 defining the chamber 14, with the inductor coil 20 omitted for clarity. FIGS. 4 to 7 illustrate the procedure for inserting the elongate susceptor element 22 into the chamber 14. It will be appreciated that the steps may be reversed to remove the elongate susceptor element from the chamber 14.

Figure 4:
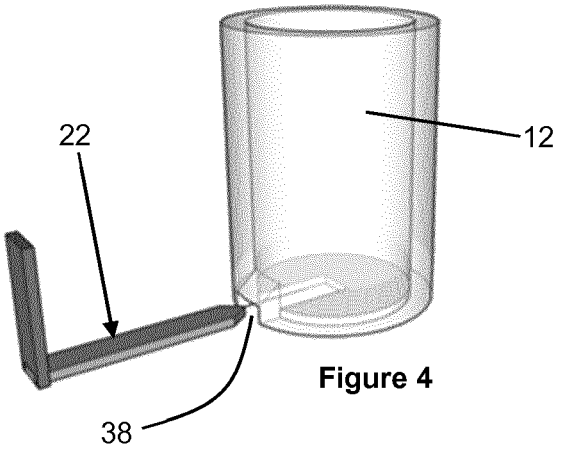
FIGS. 4 to 7 illustrate the process for inserting the elongate susceptor element into the aerosol-generating device of FIG. 1.
Figure 5:
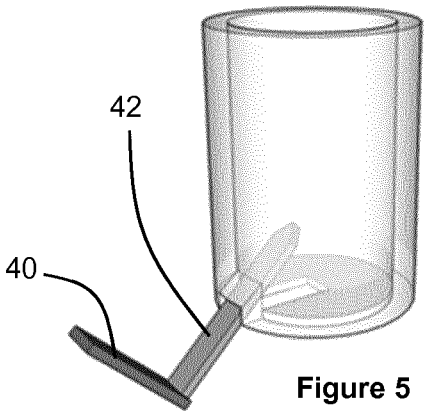
Figure 6:
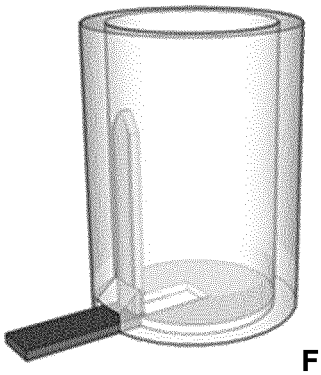
Figure 7:
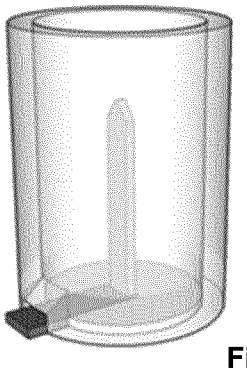

In a first step illustrated in FIG. 4, a tip of the elongate heating portion 42 of the elongate susceptor element 22 is inserted through the aperture 38, with the elongate heating portion 42 substantially perpendicular to a longitudinal axis of the chamber 14. As the remainder of the elongate heating portion 42 is inserted through the aperture 38 and into the chamber 14, the elongate susceptor element 22 is rotated through an angle of approximately 90 degrees until the elongate heating portion 42 is substantially parallel with the longitudinal axis of the chamber 14 and positioned at a side of the chamber 14 adjacent to the aperture 38 (FIGS. 5 and 6). The elongate susceptor element 22 is then pushed in a direction orthogonal to the longitudinal axis of the chamber 14 until the elongate base portion 40 engages the housing 12 and the elongate heating portion 42 is centred within the chamber 14.

Figure 8:
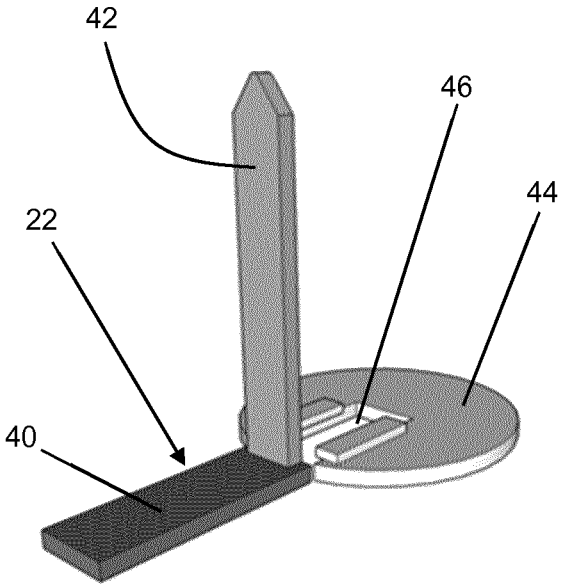
FIGS. 8 and 9 show a portion of the housing of the aerosol-generating device of FIG. 1 configured to receive the elongate susceptor element.
Figure 9:
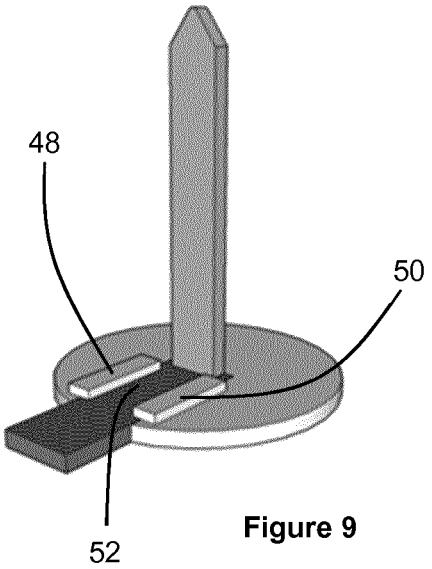
Figure 10:
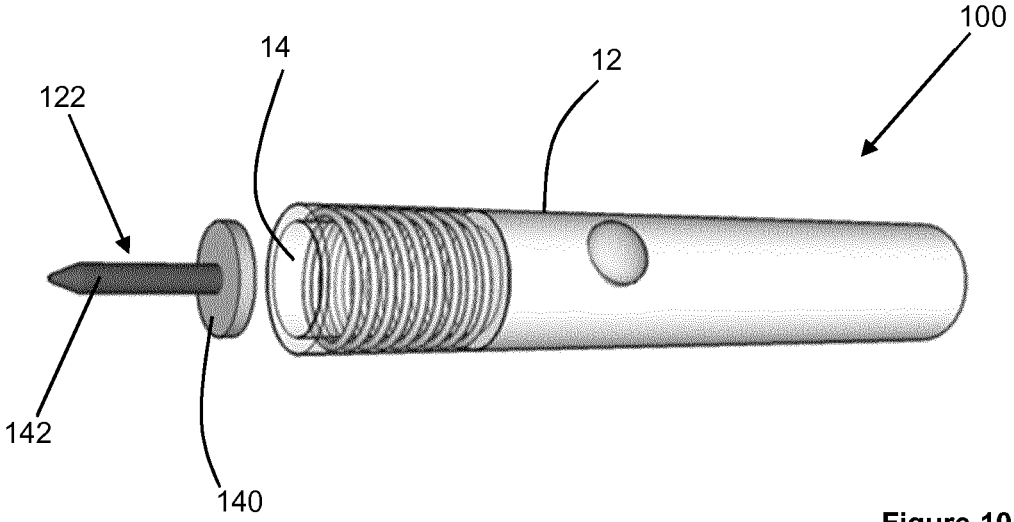
FIG. 10 shows a perspective view of an aerosol-generating device according to a second embodiment of the present invention.

FIGS. 8 and 9 show a portion of the housing 12 forming an end wall 44 which defines the closed end of the chamber 14. The end wall 44 comprises a channel 46 in which the elongate base portion 40 is received when the elongate susceptor element 22 is engaged with the housing 12. The end wall 44 also comprises first and second flanges 48, 50 partially overlying the channel 46 to retain the elongate base portion 40 within the channel 46. The first and second flanges 48, 50 are spaced apart from each other to define a slot 52 therebetween, wherein the elongate heating portion 42 slides within the slot 52 when the elongate susceptor element 22 is inserted into the chamber 14 and removed from the chamber 14.

FIGS. 10 to 14 show an aerosol-generating device 100 according to a second embodiment of the present invention. The aerosol-generating device 100 is similar to the aerosol-generating device 10 described with reference to FIGS. 1 to 9 and like reference numerals are used to designate like parts. The aerosol-generating device 100 differs in the configuration of the elongate susceptor element. The use and operation of the aerosol-generating device 100 with an aerosol-generating article 16 is the same as described with reference to the aerosol-generating device 10.

The aerosol-generating device 100 comprises an elongate susceptor element 122 configured for insertion into the chamber 14 through the open end of the chamber 14. The elongate susceptor element 122 comprises a base portion 140 and an elongate heating portion 142 extending from a centre of the base portion 140.

The elongate susceptor element 122 is configured for removable attachment to the aerosol-generating device by a magnetic attachment. The base portion 140 forms a first part of the magnetic attachment and a magnetic element 143 disposed within the housing 12 adjacent the closed end of the chamber 14 forms a second part of the magnetic attachment. At least one of the base portion 140 and the magnetic element 143 comprises a permanent magnet. The base portion 140 may comprise a permanent magnet and the magnetic element 143 may comprise a magnetisable material, such as a ferromagnetic material. The magnetic element 143 may comprise a permanent magnet and the base portion may comprise a magnetisable material, such as a ferromagnetic material. Each of the base portion 140 and the magnetic element 143 may comprise a permanent magnet.

When the elongate susceptor element 122 is inserted into the chamber 14, the magnetic attraction between the base portion 140 and the magnetic element 143 removably attaches the elongate susceptor element 122 to the closed end of the chamber 14.

Figure 11:
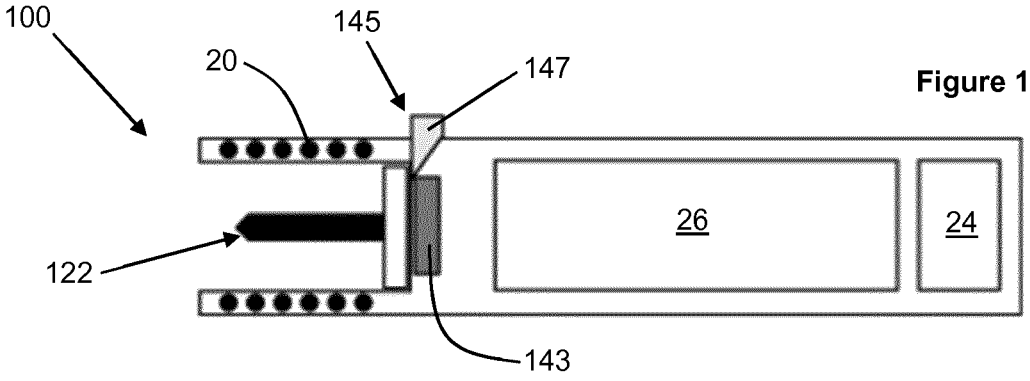
FIGS. 11 and 12 show a cross-sectional view of the aerosol-generating device of FIG. 10 comprising a release mechanism.
Figure 12:
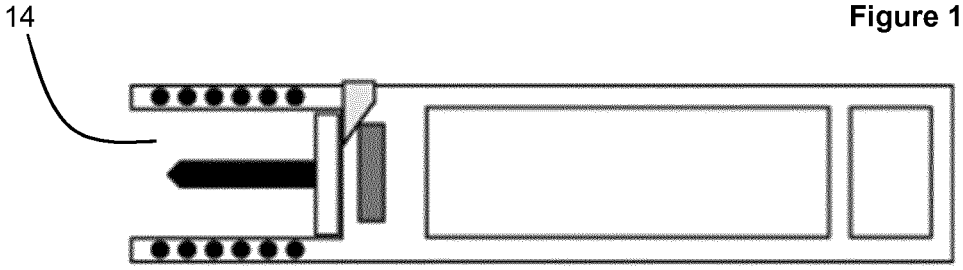

FIGS. 11 and 12 show a first arrangement of a release mechanism 145 for breaking the magnetic attachment and releasing the elongate susceptor element 122 from the chamber 14. The release mechanism 145 comprise a button 147 having a wedge shape and extending through a portion of the housing 12. When the wedge-shaped button 147 is depressed by a user the wedge-shaped button 147 is inserted between the closed end of the chamber 14 and the magnetic element 143 (FIG. 12). This results in movement of the magnetic element 143 away from the base portion 140, which breaks the magnetic attachment and releases the elongate susceptor element 122. The wedge-shaped button 147 is biased into the raised position shown in FIG. 11 by a spring.

Figure 13:
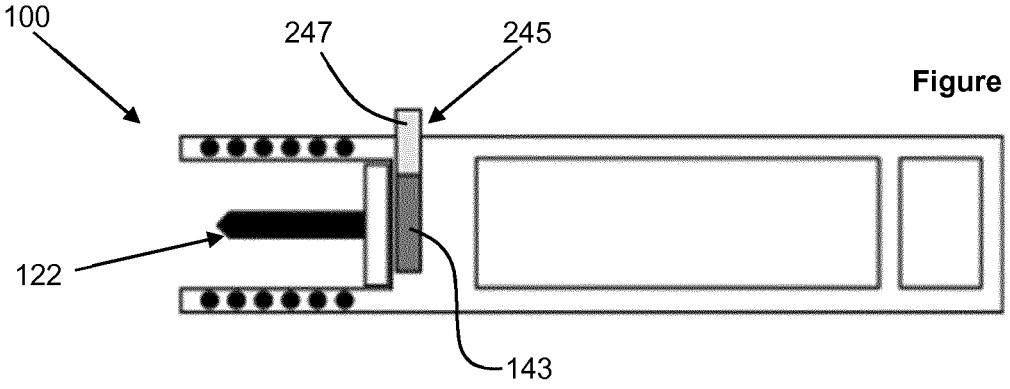
FIGS. 13 and 14 show a cross-sectional view of the aerosol-generating device of FIG. 10 comprising an alternative release mechanism.
Figure 14:
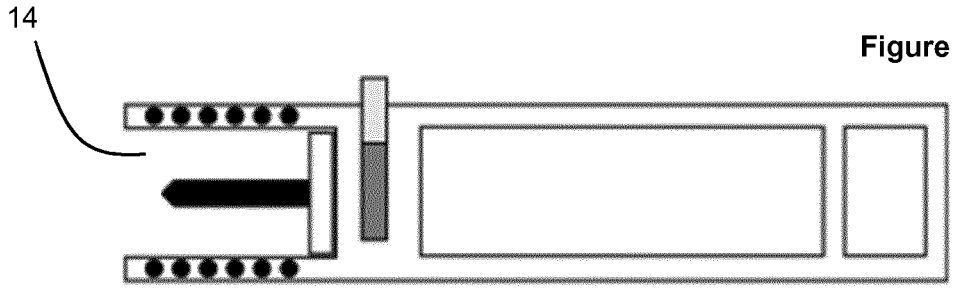

FIGS. 13 and 14 show a second arrangement of a release mechanism 245 for breaking the magnetic attachment and releasing the elongate susceptor element 122 from the chamber 14. The release mechanism 245 comprise a lever 247 extending through an elongate slot in a portion of the housing 12. The lever 247 is attached to the magnetic element 143 so that, when a user pushes the lever 247 in a direction away from the chamber 14, the magnetic element 143 is moved away from the base portion 140 (FIG. 14). This breaks the magnetic attachment and releases the elongate susceptor element 122. At least one of the lever 247 and the magnetic element 143 is biased into the position shown in FIG. 13 by a spring.

Figure 15:
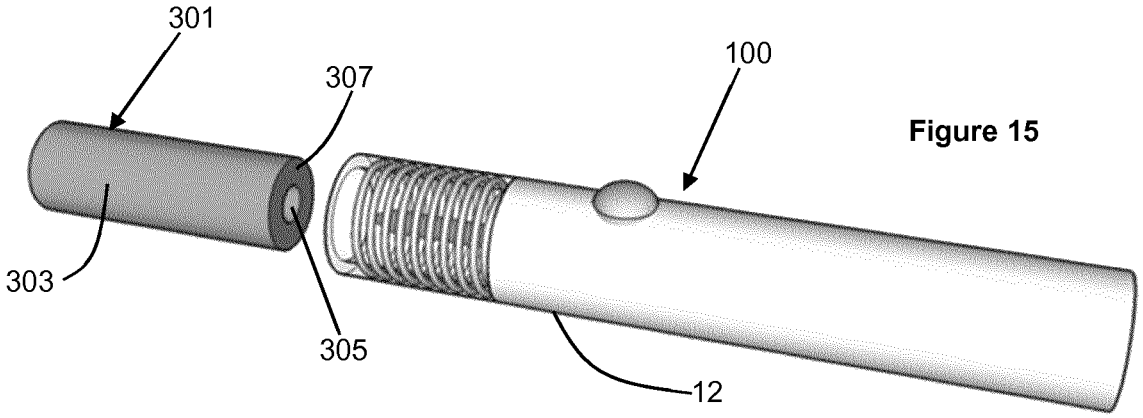
FIGS. 15 and 16 shows a perspective view of the aerosol-generating device of FIG. 10 in combination with an extraction tool.
Figure 16:
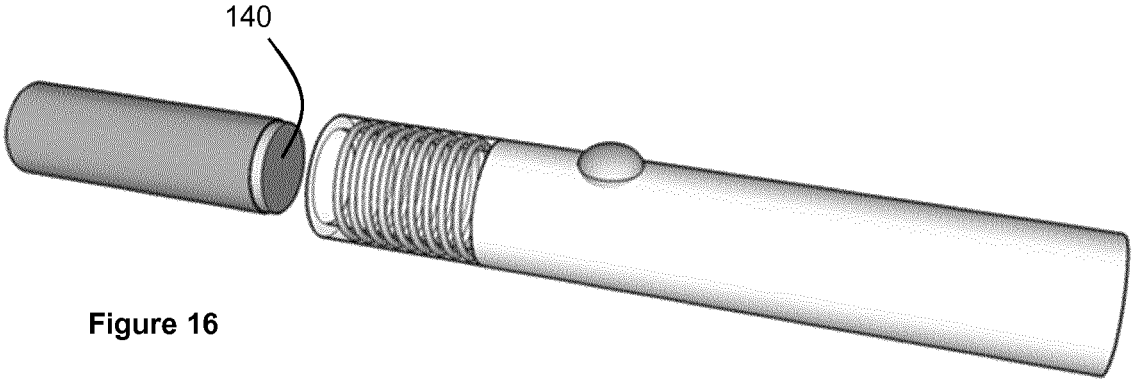

FIGS. 15 and 16 show a configuration in which the aerosol-generating device 100 does not include a release mechanism. Instead, the aerosol-generating device 100 is provided with an extraction tool 301. The extraction tool 301 comprises a cylindrical body 303 sized and shaped to be received within the chamber 14. A cavity 305 within the cylindrical body 303 is configured to receive the elongate heating portion 142 of the elongate susceptor element 122 when the extraction tool 301 is inserted into the chamber 14. The extraction tool 301 also comprises a permanent magnet 307 positioned adjacent an open end of the cavity 305 for engagement with the base portion 140 of the elongate susceptor element 122. The permanent magnet 307 of the extraction tool 301 is configured to provide an attractive force between the permanent magnet 307 and the base portion 140 than the attractive force between the base portion 140 and the magnetic element 143. Therefore, when the extraction tool 301 is inserted into the chamber 14 and then removed, the elongate susceptor element 122 is removed with the extraction tool 301, as shown in FIG. 16.

Figure 17:
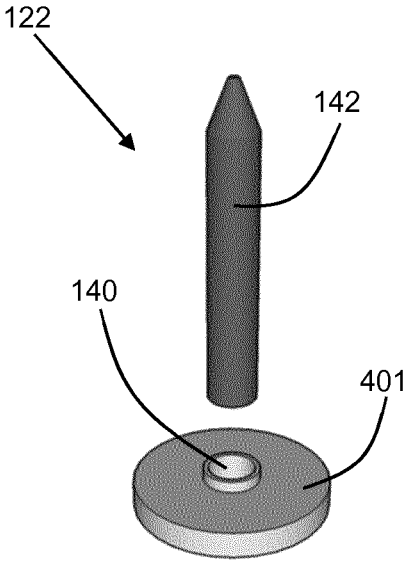
FIG. 17 shows an exploded perspective view of the elongate susceptor element of the aerosol-generating device of FIG. 10.

FIG. 17 shows a configuration of the elongate susceptor element 122 in which the elongate heating portion 142 is detachable from the base portion 140. The base portion 140 comprises an aperture 401 for receiving and retaining an end of the elongate heating portion 142 by an interference fit. This arrangement allows the elongate heating portion 142 to be replaced separately from the base portion 140. This may be particularly advantageous in embodiments in which the base portion 140 comprises a permanent magnet and may be more costly to manufacture than the elongate heating portion 142.

Figure 18:
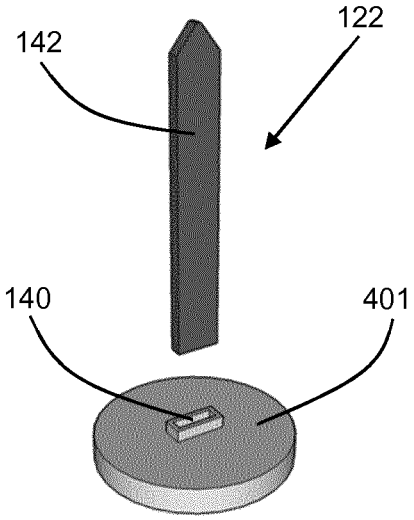
FIG. 18 shows an exploded perspective view of an alternative elongate susceptor element for use in the aerosol-generating device of FIG. 10.

In the configuration shown in FIG. 17 the elongate heating portion 142 has a pin shape. In an alternative configuration shown in FIG. 18, the elongate heating portion 142 has a flat blade shape.

The invention claimed is:

1. An aerosol-generating device, comprising:

a housing defining a chamber configured to receive at least a portion of an aerosol-generating article;

an inductor coil disposed around at least a portion of the chamber;

an elongate susceptor element configured for removable attachment to the housing within the chamber, wherein the elongate susceptor element projects into the chamber when the elongate susceptor element is removably attached to the housing;

an aperture positioned on a side of the housing, wherein the aperture and the elongate susceptor element are configured for insertion of the elongate susceptor element into the chamber through the aperture and configured for removal of the elongate susceptor element from the chamber through the aperture; and a power supply and a controller connected to the inductor coil and configured to provide an alternating electric current to the inductor coil such that the inductor coil generates an alternating magnetic field to heat the elongate susceptor element and thereby heat at least a portion of the aerosol-generating article received within the chamber.

2. The aerosol-generating device according to claim 1, wherein the elongate susceptor element comprises an elongate base portion and an elongate heating portion extending from a first end of the elongate base portion, and wherein the elongate base portion is orthogonal to the elongate heating portion.

3. The aerosol-generating device according to claim 2, wherein the housing defines a channel extending at least partially across a closed end of the chamber from the aperture, and wherein the channel is configured to receive the elongate base portion of the elongate susceptor element.

4. The aerosol-generating device according to claim 3, wherein the channel is configured to retain the elongate base portion of the elongate susceptor element by an interference fit.

5. The aerosol-generating device according to claim 3, wherein the housing defines at least one flange extending across at least a portion of the channel, and wherein the at least one flange is configured to retain the elongate base portion of the elongate susceptor portion within the channel.

6. The aerosol-generating device according to claim 5, wherein the at least one flange at least partially defines a slot, and wherein the channel, the slot, and the elongate susceptor element are configured such that the elongate heating portion of the elongate susceptor element extends through the slot when e elongate base portion is retained within the channel.

7. The aerosol-generating device according to claim 1, wherein a portion of the elongate susceptor element s configured to protrude through the aperture when the elongate susceptor element is received within the chamber.

8. An aerosol-generating device, comprising:

a housing defining a chamber configured to receive at least a portion of an aerosol-generating article;

an inductor coil disposed around at least a portion of the chamber;

an elongate susceptor element configured for removable attachment to the housing within the chamber, wherein the elongate susceptor element projects into the chamber when the elongate susceptor element is removably attached to the housing, and wherein the elongate susceptor element comprises a base portion configured for removable attachment to the housing and an elongate heating portion extending from the base portion; and a power supply and a controller connected to the inductor coil and configured to provide an alternating electric current to the inductor coil such that the inductor coil generates an alternating magnetic field to heat the elongate susceptor element and thereby heat at least a portion of the aerosol-generating article received within the chamber.

9. The aerosol-generating device according to claim 8, wherein the elongate heating portion extends from a centre of the base portion.

10. The aerosol-generating device according to claim 8, wherein the base portion of the elongate susceptor element is configured for removable attachment to the housing by a magnetic attachment.

11. The aerosol-generating device according to claim 10, wherein the base portion comprises a permanent magnet and the aerosol-generating device comprises a ferromagnetic material at an upstream end of the chamber, or wherein the base portion comprises a ferromagnetic material and the aerosol-generating device comprises a permanent magnet at an upstream end of the chamber, or wherein the base portion comprises a permanent magnet and the aerosol-generating device comprises a permanent magnet at an upstream end of the chamber.

12. The aerosol-generating device according to claim 10, further comprising a release mechanism configured to provide relative movement between the elongate susceptor element and the aerosol-generating device to break the magnetic attachment.

13. An extraction tool for an aerosol-generating device according to claim 10, the extraction tool being sized for insertion into the chamber and comprising a permanent magnet at an end of the extraction tool.

14. An aerosol-generating system, comprising:

an aerosol-generating device according to claim 1; and an aerosol-generating article having an aerosol-forming substrate and being configured for the aerosol-generating device.

* * * * *